US007628870B2

(12) United States Patent
Blackwell et al.

(10) Patent No.: US 7,628,870 B2
(45) Date of Patent: Dec. 8, 2009

(54) HEAT TREATED VALVE GUIDE AND METHOD OF MAKING

(75) Inventors: C. Bruce Blackwell, Carmel, IN (US); Howard M. Livingston, Long Grove, IL (US)

(73) Assignee: Helio Precision Products, Inc., Lake Bluff, IL (US)

( * ) Notice: Subject to any disclaimer, the term of this patent is extended or adjusted under 35 U.S.C. 154(b) by 230 days.

(21) Appl. No.: 11/053,395

(22) Filed: Feb. 8, 2005

(65) Prior Publication Data

US 2006/0174982 A1 Aug. 10, 2006

(51) Int. Cl.
*C22C 37/08* (2006.01)
*C22C 37/00* (2006.01)

(52) U.S. Cl. ..... 148/321; 148/612

(58) Field of Classification Search ..... 148/321; 420/17

See application file for complete search history.

(56) References Cited

U.S. PATENT DOCUMENTS

| | | | | |
|---|---|---|---|---|
| 1,973,263 | A | | 9/1934 | Mitchell |
| 3,370,941 | A | | 2/1968 | Keuny |
| 3,384,515 | A | | 5/1968 | Ackerman |
| 3,472,651 | A | | 10/1969 | Keuny |
| 4,032,334 | A | | 6/1977 | Burk |
| 4,124,413 | A | | 11/1978 | Komatsu |
| 4,230,506 | A | | 10/1980 | Clark |
| 4,482,396 | A | * | 11/1984 | Yamamoto et al. ..... 148/544 |
| 4,484,547 | A | * | 11/1984 | Nickerson ..... 123/188.9 |
| 5,441,024 | A | * | 8/1995 | Wietig et al. ..... 123/188.3 |
| 5,972,128 | A | | 10/1999 | Miwa |

OTHER PUBLICATIONS

European Search Report, dated Apr. 25, 2006 issued for European patent application counterpart of above application.

Abstracts of Japan, Publication No. 2001107173, dated Apr. 17, 2001.

*Metals Handbook*, 8th Edition, vol. 1, 1961, Properties and Selection of Metals, pp. 363-365, American Society for Metals, Novelty, Ohio.

*Metals Handbook*, 8th Edition, vol. 2, 1964, Treating, Cleaning, and Finishing, pp. 207-211, American Society for Metals, Metals Park, Ohio.

* cited by examiner

*Primary Examiner*—Roy King
*Assistant Examiner*—Jie Yang

(57) ABSTRACT

A valve guide of alloyed gray cast iron comprising from about 3 to about 3.5 wt. % carbon, about 0.2 wt. % phosphorous maximum, from about 0.35 to about 0.75 wt. % molybdenum, from about 1.8 to about 3 wt. % silicon, from about 0.6 to about 1 wt. % manganese, from about 0.8 to about 1.5 wt. % chromium, balance essentially iron, is heat treated by austenitizing, quenching, and tempering, to obtain a Rockwell C hardness from about 35 to about 45. The microstructure comprises at least about 3% intercellular carbide in a matrix of tempered martensite. Such valve guide exhibits improved wear resistance during use in an internal combustion engine.

15 Claims, No Drawings

HEAT TREATED VALVE GUIDE AND METHOD OF MAKING

FIELD OF INVENTION

This invention relates to a process for producing alloyed gray cast iron valve guides that are heat treated to obtain improved wear during operation and good machineability during manufacture into a finished valve guide. The process includes a heat treatment comprising austenitizing followed by quenching and tempering to obtain a Rockwell C hardness from about 35 to about 45 and a microstructure comprising at least about 3% intercellular carbide in a matrix of tempered martensite. Such hardness and microstructure not only serves to minimize wear of the valve stem during contact with the valve guide during operation of an internal combustion engine, and a tempered martensite microstructure improves machineability during finish or final machining of the valve guide during manufacture thereof.

BACKGROUND OF THE INVENTION

Valve guides are press fit into smaller diameter cylindrical mating bores contained in internal combustion engine heads to obtain a stable fit between the two components. A stable fit is desirable to prevent subsequent loosening during operation of the engine and to facilitate heat transfer between the components. Valve guide blanks are hollowed to obtain a center hole that surrounds and contacts the elongated cylindrical valve stem during operation of the engine. The valve stem moves axially during operation of the engine, and thus wear is created. While it is desirable in general to decrease wear between the valve guide and valve stem, it is desired to have the majority of wear occur on the surface of the interior center hole of the valve guide rather than on the valve stem. Excessive wear on the valve stem can lead to breakage of the stem and consequent catastrophic engine failure.

Blanks for subsequent fabrication into valve guides for use in internal combustion engines may comprise ferrous or nonferrous metals and have been formed by powder metallurgy processes or from cast metals. The present invention relates to an improved process for making cast and heat-treated alloyed gray cast iron valve guide blanks having a hardness that is compatible with the hardness of the valve stem. Such compatibility minimizes wear to occur on the surface of the interior center hole of the valve guide rather than on the surface of the valve stem. This hardness compatibility serves to reduce the incidence of unacceptable excess exhaust emissions and possible engine failure. In addition, a microstructure of the alloyed cast iron valve guide comprising at least about 3% intercellular carbide in a tempered martensite matrix reduces wear of the internal surface of the valve guide.

Gray cast irons are well known in the art and may be used in the as-cast or heat-treated conditions. United States patents directed to such gray cast irons include U.S. Pat. Nos. 1,973,263; 3,384,515; 3,370,941; 3,472,651; 4,032,334; and 4,124,413.

Prior processes for making gray cast iron valve guides include two general approaches. A first approach involves the use of unalloyed gray cast iron that is subjected to heat treatment to obtain desired mechanical properties, such as increased tensile strength and impact resistance. Such heat treatments comprise austenitizing followed by quenching and tempering and are more fully described at pages 207-210 of Volume 2 of the 8$^{th}$ *Edition of Metals Handbook* entitled "Heat Treating, Cleaning and Finishing" (1964) and pages 363-365 of Volume 1 of the 8$^{th}$ *Edition of Metals Handbook* entitled "Properties and Selection of Metals" (1961). A second approach involves the use of alloying to modify such as-cast mechanical properties as strength and hardness. The effect of certain alloying elements is discussed in greater detail at aforesaid pages 363-365.

The present invention is specifically directed to the manufacture of alloyed gray cast iron valve guides with use of a process that includes heat-treating by austenitizing followed by quenching and tempering. Pages 209-210 of aforesaid pages 207-210 include Examples 1 and 2, which specifically deal with the heat treatment of unalloyed gray cast iron valve guides. The heat treatments disclosed involved austenitizing at 1600° to 1625° F., oil quenching, and then tempering at 900° to 925° F. to obtain a Rockwell C hardness of approximately 30 to 34.

In contrast with the above-discussed prior art activity, the present invention provides an improved manufacturing process, and resultant valve guide product, that is characterized by a heat treatment designed to achieve a tempered martensite microstructure that enhances machineability during the finish machining operation used to form the valve guide and results in a microstructure that reduces wear on the interior surface of the valve guide during operation.

SUMMARY OF THE INVENTION

The present invention relates to a method of making a valve guide for use in an internal combustion engine. The method generally comprises providing an elongated blank of gray cast iron having a composition comprising from about 3 to about 3.5 wt. % carbon; about 0.2 wt. % phosphorous maximum; from about 0.35 to about 0.75 wt. % molybdenum; from about 1.8 to about 3 wt. % silicon; from about 0.6 to about 1 wt. % manganese; from about 0.8 to about 1.5 wt. % chromium, with the balance being essentially iron. Alloying elements, such as chromium and molybdenum, form carbides that contribute to the minimization of wear of the valve guide. The blank is machined to form a generally round cylindrical shape, and then a center hole is formed along the longitudinal center axis of the cylinder. The hollowed, rounded blank is then heat-treated to obtain a Rockwell C hardness of from about 35 to about 45. The heat treatment generally comprises heating the blank to an austenitizing temperature sufficient to promote formation of austenite and for a time sufficient to dissolve carbon in the austenite, then quenching the blank in a quenching medium to form martensite, and then heating the quenched blank to a temperature from about 1000° F. to about 1200° F. to temper the martensite and obtain a microstructure of at least about 3% intercellular carbide in a matrix of tempered martensite and a hardness of Rockwell C from about 35 to about 45. The alloyed gray cast iron of the invention forms a relatively larger amount of carbides because of the presence of carbide-forming alloying elements, such as chromium and, molybdenum. The valve guide of the invention has a higher hardness in the quenched condition than if an unalloyed gray cast iron was utilized. Thus, a higher tempering temperature is required to obtain a corresponding hardness level.

The final product produced by the process of the present invention comprises an elongated, cylindrical valve guide having a hollow center portion and a machined, finished surface. The gray cast iron comprises from about 3 to about 3.5 wt. % carbon; about 0.2 wt. % phosphorous maximum; from about 0.35 to about 0.75 wt. % molybdenum; from about 1.8 to about 3 wt. % silicon; from about 0.6 to about 1 wt. % manganese; from about 0.8 to about 1.5 wt. % chromium, with the balance being essentially iron. The valve guide exhibits a microstructure of at least about 3% intercellular carbide in a matrix of tempered martensite microstructure and a Rockwell C hardness from about 35 to about 45.

DETAILED DESCRIPTION OF THE INVENTION

Valve guides are typically hollow metal cylinders that are installed in internal combustion engine heads as axial guide bearings for valve stems. The guides serve to hold the valve face coaxial to the head or block seat and also serve as a heat sink to cool the valves. The most common installation procedure is to secure the valve guide through a press fit between the valve guide and the cylindrical mating bore.

The valve guides of the present invention comprise gray cast iron that has been heat treated to obtain a Rockwell C hardness from about 35 to about 45 and a microstructure comprising at least about 3% intercellular carbide in a matrix of tempered martensite. In the composition of the invention, such carbides are primarily formed by chromium and, to a lesser extent, by molybdenum. During operation in an internal combustion engine, the respective longitudinal surfaces of the valve guide and valve stem contact each other and pass against each other in an up-and-down motion. Such contact and motion causes wear on these surfaces over a period of time. To minimize catastrophic failure of the valve stem, it is desired to minimize wear on the valve stem as opposed to the valve guide. For this reason, the hardness of each of these two engine components is important. Valve stems typically have an equivalent surface hardness, after chrome plating or other surface treatments, as measured by Rockwell C testing, from about 45 to about 60. By employing a valve guide having a lower surface hardness, for example, Rockwell C of from about 35 to about 45, harmful wear on the valve stem surface can be minimized. Wear on the inner surface of the valve guide is further minimized by having a heat treated microstructure of at least about 3% intercellular carbide contained in a matrix of tempered martensite. A tempered martensitic microstructure is also desirable because such microstructure enhances machineability during the finish-machining step that is required following heat treatment to prepare and texture the valve guide surface for subsequent assembly by press fitting into the cylindrical mating bore in the engine head and for subsequent use in combination with the valve stem. As may be seen, a Rockwell C hardness from about 35 to about 45 and along with a microstructure comprising at least about 3% intercellular carbide in a matrix of tempered martensite results in good machineability during finish machining of the heat-treated blank.

The gray cast iron of the present invention generally comprises about 3 to about 3.5 wt. % carbon; about 0.2 wt. % phosphorous; from about 0.35 to about 0.75 wt. % molybdenum; from about 1.8 to about 3 wt. % silicon; from about 0.6 to about 1 wt. % manganese; from about 0.8 to about 1.5 wt. % chromium, with the balance being essentially iron. A preferred gray cast iron comprises from about 3.1 to about 3.4 wt. % carbon; about 0.2 wt. % phosphorous maximum; about 0.15 wt. % sulfur maximum; from about 0.45 to about 0.65 wt. % molybdenum; from about 2.1 to about 2.8 wt. % silicon; from about 0.6 to about 0.9 wt. % manganese; from about 1 to about 1.3 wt. % chromium, with the balance being essentially iron. The preferred ranges provide for tighter compositional control and enhanced predictability in properties of the valve guide. The general and the preferred compositions may optionally further include from 0.4 to about 1 wt. % nickel and from about 0.2 to about 1 wt. % copper. To cause a further increase in strength, it is further preferred to include from about 0.4 to about 0.7 wt. nickel, and from about 0.4 to about 0.7 wt. % copper. The gray cast iron compositions of the invention may further include normal impurities and other elements in residual amounts that do not affect the characteristics of the gray cast iron.

A blank of the above-denoted gray cast iron is obtained by casting molten gray iron in a mold or the like. The casting is elongated and generally round and cylindrical in shape. The blank is then machined to improve roundness. Grinding is a typical method for obtaining the desired roundness, but other types of machining such as broaching, turning, etc., may be utilized.

A center hole is then formed along the longitudinal axis of the blank to form an elongated, cylindrical hollow valve guide blank. The hole may be formed by drilling.

The blank is then heat treated by heating the blank to an austenitizing temperature sufficient to promote the formation of austenite and for a time sufficient to dissolve carbon in the austenite. Austenitizing temperatures on the order of about 1500° to about 1800° F. may be utilized, with about 1550° to about 1650° F. being typical. Holding times on the order of from about one to two hours are typically satisfactory to ensure the desired austenite formation and carbon solution. Heating may be conducted in conventional heating furnaces, such as oil and gas fired types.

Following austenitizing, the blank is quenched to form martensite. Quenching rates must be sufficiently rapid to form martensite but not too rapid as to result in stress cracking of the blank. Quenching in an oil bath results a cooling rate that achieves the above-enumerated objectives, and is thus preferred; although other quenching mediums having cooling characteristics similar to oil may be used.

The blank is tempered to soften it to the desired hardness range of about Rockwell C 35 to about 45 following quenching. A hardness of Rockwell C from about 37 to about 43 is preferred to enhance predictability. Tempering is achieved by heating the quenched blank to a temperature of from about 1000° to about 1200° F. for a time sufficient to obtain such desires hardness. Typically tempering times from about one-half hour to about eight hours may be employed. One- or two-stage tempering processes may be utilized. Tempering may be accomplished in conventional furnaces including oil or gas fired furnaces.

Following tempering, the surface of the heat-treated blank is formed into a desired finish to make a finished valve guide. Conventional machining operations such as grinding, including centerless grinding, may be used. Such surface grinding forms a textured surface, typically having a maximum of about 64 microinches, as measured by a profilometer. The valve guide may be further coated with an oil lubricant and/or a coating capable of containing such lubricant. Phosphates, black oxide, and other coatings may be utilized to hold the lubricant prior to press fitting into the engine head. The lubricant serves to facilitate the press fitting operation.

The product of the above-described process is an elongated gray cast iron valve guide in the heat-treated condition having a cylindrical finish ground surface. The hardness ranges from about Rockwell C 35 to about 45. The microstructure of the valve guide is intercellular carbide in a tempered martensite matrix. The amount of intercellular carbide is at least about 3% with a typical range of from about 3% to about 10%. It is preferred to have about 4% to about 8% of intercellular carbide in a matrix of tempered martensite because the lower portion of such preferred range further provides the requisite wear minimization and the upper portion of such range results in improved machineability. The composition is that described above.

The practice of the present invention is further illustrated by the following examples.

Example 1

An elongated, cylindrical gray cast iron valve guide blank, having a composition of 3.50 wt. % C; 0.03 wt. % P; 0.04 wt. % S; 2.20 wt. % Si; 0.83 wt. % Mn; 0.78 wt. % Ni; 0.41 wt. % Cr; 0.40 wt. % Mo; 0.59 wt. % Cu, balance essentially Fe, is formed as a casting. The casting is machined by grinding into a generally round shape. A longitudinal center hole is then formed in the generally round shaped blank by drilling. Next the blank is heat treated by heating to about 1600° F. for about one hour to form austenite in the gray cast iron. Then the blank is quenched in oil to form martensite and then is tempered at 800° F. for one hour. The resultant microstructure is about 1% to 2% intercellular carbide in a matrix of tempered martensite. The hardness of the valve guide following the above heat treatment is Rockwell C 38. The surface of the heat-treated blank is then finish machined by centerless grinding. The thus manufactured valve guide is suitable for assembly into and use in an internal combustion engine.

Example 2

An elongated, cylindrical gray cast iron valve guide blank, having a composition of 3.30 wt. % C; 0.13 wt. % P; 0.05 wt. % S; 0.33 wt. % Ni; 0.31 wt. % Cu; 0.46 wt. % Mo; 2.44 wt. % Si; 0.67 wt. % Mn; 1.01 wt. % Cr, balance essentially Fe, is formed as a casting. The casting is machined by grinding into a generally round shape. A longitudinal center hole is then formed in the generally round shaped blank by drilling. Next the blank is heat treated by heating to about 1600° F. for about one hour to form austenite in the gray cast iron. Then the blank is quenched in oil to form martensite and then is tempered at 1100° F. for one hour. The resultant microstructure is about 6% to 8% intercellular carbide in a matrix of tempered martensite. The hardness of the valve guide following the above heat treatment is Rockwell C 41. The surface of heat-treated blank is then finish machined by centerless grinding. The thus manufactured valve guide is suitable for assembly into and use in an internal combustion engine.

Example 3

The heat-treated valve guides of Examples 1 and 2 are subjected to metallographic evaluation at the mid-radius (wear) surface location. This location approximates a major wear surface of the valve guide when in contact with the valve stem. Full cross sections from each sample are removed and are metallographically prepared for examination and rating of the graphite type and matrix in accordance with ASTM E3-01 and ASTM A247-67 (1998), Plates II and III. The examinations are performed in the unetched and etched conditions at magnifications of 1,000×.

An examination of the samples from Examples 1 and 2 in the unetched condition reveals similar conditions. Both samples consist of a mixed random orientation of graphite flakes rated as predominantly (90% minimum) ASTM Type A, Size 4, and Size 5, respectively. Evidence is also observed of less than 5% of Type E graphite.

Examination of the samples in the etched condition reveals differences in the two matrix microstructures. The microstructure of the sample from Example 1 is estimated to contain 1% to 2% intercellular carbide in a matrix of tempered martensite. The microstructure of the sample from Example 2 is estimated to contain 6% to 8% intercellular carbide in a matrix of tempered martensite. The larger amount of carbide is directly related to the increased amount of alloying. Tempering of the martensite absorbed in both samples contributes to improved machineability. Increased amounts of intercellular carbide in the matrix of the sample from Example 2 increases the wear resistance of the valve guide as compared to the sample from Example 1.

In summary, tempering of the martensite in the samples contributes to improved machineability. In addition, increased amounts of intercellular carbide in a matrix of tempered martensite increases the wear resistance of the valve guide.

It is claimed:

1. A method of making a valve guide having enhanced wear resistance when used in an internal combustion engine comprising:

(a) Providing an elongated blank of gray cast iron comprising from about 3 to about 3.5 wt. % carbon, about 0.2 wt. % phosphorous maximum, from about 0.35 to about 0.75 wt. % molybdenum, from about 1.8 to about 3 wt. % silicon, from about 0.6 to about 1 wt. % manganese, from about 0.8 to about 1.5 wt. % chromium, balance essentially iron;

(b) Machining said blank to form a generally round shape;

(c) Forming a center hole along a longitudinal axis of said rounded blank;

(d) Heat treating said rounded blank containing said center hole by heating the blank to an austenitizing temperature sufficient to promote formation of austenite and for a time sufficient to dissolve carbon in said austenite, quenching said blank in a quenching medium to form martensite, and the heating said quenched blank to a temperature from about 1000° F. to about 1200° F. to temper said martensite and obtain a microstructure comprising 3% or more molybdenum and chromium intercellular carbides in a matrix of tempered martensite and to obtain a Rockwell C hardness of about 35 to about 45;

(e) Machining said heat-treated blank to form a valve guide; and (f) contacting an interior surface of said valve guide against a valve stem having a hardness greater than that of said valve guide so that when said valve stem is contacted and passed against said valve guide interior surface, wear on said valve stem during said contact is minimized.

2. The method of claim 1 wherein said gray cast iron further comprises from about 0.2 to about 1.0 wt. % nickel and from about 0.2 to about 1.0 wt. % copper.

3. The method of claim 2 wherein said gray cast iron further comprises from about 0.4 to about 0.7 wt. nickel and from about 0.4 to about 0.7 wt. % copper.

4. The method of claim 1 wherein said gray cast iron comprises from about 3.1 to about 3.4 wt. % carbon, about 0.2 wt. % phosphorous maximum, about 0.15 wt. % sulfur maximum, from about 0.45 to about 0.65 wt. % molybdenum, from about 2.1 to about 2.8 wt. % silicon, from about 0.6 to about 0.9 wt. % manganese, from about 1 to about 1.3 wt. % chromium, balance essentially iron.

5. The method of claim 4 wherein said gray cast iron further comprises from about 0.2 to about 1 wt. % nickel and from about 0.2 to about 1 wt. % copper.

6. The method of claim 5 wherein said gray cast iron comprises from about 0.4 to about 0.7 wt. % nickel and from about 0.4 to about 0.7 wt. % copper.

7. The method of claim 1, wherein said microstructure comprises from about 4% to about 8% molybdenum and chromium intercellular carbide in a matrix of tempered martensite.

8. An elongated gray cast iron valve guide having an interior center hole with an interior surface contained in an internal combustion engine and in the heat-treated condition having a cylindrical, finish ground surface, a Rockwell C hardness from about 35 to about 45, and a microstructure comprising 3% or more molybdenum and chromium intercellular carbide in a matrix of tempered martensite; said gray cast iron having a composition comprising from about 3 to about 3.5 wt. % carbon, about 0.2 wt. % phosphorous maximum, from about 0.35 to about 0.75 wt. % molybdenum, from about 1.8 to about 3 wt. % silicon, from about 0.6 to about 1 wt. % manganese, from about 0.8 to about 1.5 wt. % chromium, balance essentially iron, said valve guide having said interior surface in contact with and passing against a valve stem having a hardness greater than that of said valve guide whereby wear on said valve stem during said contact is minimized.

9. The elongated gray cast iron valve guide of claim 8, wherein said gray cast iron further comprises from about 0.2 to about 1.0 wt. % nickel and from about 0.2 to about 1.0 wt. % copper.

10. The elongated gray cast iron valve guide of claim 9, wherein said gray cast iron further comprises from about 0.4 to about 0.7 wt. Nickel and from about 0.4 to about 0.7 wt. % copper.

11. The elongated gray cast iron valve guide of claim 9, wherein said gray cast iron comprises from about 3.1 to about 3.4 wt. % carbon, about 0.2 wt. % phosphorous maximum, about 0.15 wt. % sulfur maximum, from about 0.45 to about 0.65 wt. % molybdenum, from about 2.1 to about 2.8 wt. % silicon, from about 0.6 to about 0.9 wt. % manganese, from about 1 to about 1.3 wt. % chromium, balance essentially iron.

12. The elongated gray cast iron valve guide of claim 11, wherein said gray cast iron further comprises from about 0.2 to about 1 wt. % nickel and from about 0.2 to about 1 wt. % copper.

13. The elongated gray cast iron valve guide of claim 12, wherein said gray cast iron further comprises about 0.4 to about 0.7 wt. % nickel and from about 0.4 to about 0.7 wt. % copper.

14. The elongated gray cast iron valve guide of claim 8, wherein said microstructure comprises from about 4% to about 8% molybdenum and chromium intercellular carbide in a matrix of tempered martensite.

15. The elongated gray cast iron valve guide of claim 8 wherein said valve stem has a Rockwell C hardness of about 45 to about 60.

* * * * *